United States Patent [19]

Minter et al.

[11] Patent Number: 4,802,065

[45] Date of Patent: Jan. 31, 1989

[54] EMERGENCY LIGHTING FIXTURE

[76] Inventors: Ronald H. Minter, 780 Maple Hills Rd.; Robert J. McCue, 11 Copper Hill Dr., both of Guilford, Conn. 06437

[21] Appl. No.: 89,839

[22] Filed: Aug. 27, 1987

[51] Int. Cl.[4] ..... F21V 19/04

[52] U.S. Cl. ..... 362/20; 362/147; 362/254; 362/276; 362/365

[58] Field of Search ..... 362/20, 147, 254, 150, 362/276, 365, 802, 149; 307/66, 64; 315/86; 340/292, 333

[56] References Cited

U.S. PATENT DOCUMENTS

| | | | |
|---|---|---|---|
| 1,938,237 | 5/1933 | Wagenhorst | 362/147 |
| 2,198,077 | 4/1940 | Curtis | 362/147 |
| 4,180,850 | 12/1979 | Bivens | 362/285 |
| 4,233,652 | 11/1980 | Oswald | 362/276 |
| 4,306,279 | 12/1981 | Cohen | 362/365 |
| 4,516,191 | 5/1985 | Moriyama | 362/65 |
| 4,651,258 | 3/1987 | Davis et al. | 362/386 |
| 4,708,223 | 11/1987 | Orndorff et al. | 362/20 |

OTHER PUBLICATIONS

Capri Lighting Catalog (1984) "Caprilow Voltage", pp. 7 & 11, 6430 E. Slauson Ave.; Los Angeles, California 90040.

*Primary Examiner*—James C. Yeung
*Attorney, Agent, or Firm*—John R. Doherty

[57] ABSTRACT

An emergency lighting fixture for mounting in a ceiling and particularly a suspended ceiling, which includes a drop down panel normally closing an opening in the ceiling and an electric lamp concealed behind the panel. If a.c. power should fail, the panel automatically drops down below the level of the ceiling along with the electric lamp and the lamp automatically turns on to illuminate a selected path of egress.

32 Claims, 3 Drawing Sheets

EMERGENCY LIGHTING FIXTURE

The present invention relates in general to emergency lighting and more particularly to an emergency lighting fixture for mounting in a ceiling which includes a drop down panel with an electric lamp concealed behind the panel.

BACKGROUND OF THE INVENTION

Currently, emergency lighting as required by most government regulations consists mainly of three basic types. The first type involves the use of a centralized cabinet containing batteries, a charger, an a.c. failure detector, a transfer switch, and a distribution circuit. This unit may also include an inverter to provide a.c. current instead of d.c. current to the lighting loads in case of emergency.

The second type of emergency lighting involves the use of small boxes which are placed around the walls of a building with contents similar to that described above. These boxes may have electric lamps mounted directly on them or the boxes may be located inside a cupboard or closet with the lamps mounted on a nearby wall, for example.

A third type of emergency lighting consists of ceiling fixtures mainly for suspended ceilings wherein the box containing the electrical components is mounted above the ceiling and the emergency lamps hang below the ceiling into the living space. The present invention is directed to this type of lighting equipment.

For optimum performance, it is usually required that ceiling fixtures of the type referred to above have their emergency lamp assemblies located above head weight with lens systems that can adequately illuminate the path of egress within a building.

As a general rule, architects and interior designers do not favor these requirements for several reasons. First of all, the lamp assemblies intrude into hallways, lobbies and other places where they may be required and do not blend with the design decor. Moreover, the lamp assemblies are exposed and can be easily damaged by accident or vandals requiring frequent replacement.

It is therefore an important object of the present invention to provide an improved emergency lighting fixture of the type which can be mounted in a ceiling.

Another object of the present invention is to provide such an improved emergency lighting fixture in which the lamp assemblies are totally concealed during the time that the unit is on stand-by service.

A more specific object of the present invention is to provide such an improved emergency lighting fixture in which the lamp assemblies automatically drops below the level of the ceiling upon the occurrence of a predetermined emergency and the lamps automatically turn on to illuminate selected paths of egress.

BRIEF DESCRIPTION OF THE INVENTION

The present invention, in its broadest aspect, resides in an emergency lighting fixture for mounting in a ceiling and particularly a suspended ceiling, which comprises, in combination: a panel normally closing an opening in the ceiling, an electric lamp mounted behind the panel, an a.c. power supply, means responsive to the presence of a.c. power from the power supply for retaining the panel in its normally closing position at the opening while at the same time allowing the panel to drop below the ceiling along with the lamp in the absence of a.c. power, a d.c. power supply and switch means for electrically connecting the d.c. power supply to the lamp for illuminating the same in response to an a.c. power failure.

DESCRIPTION OF THE PREFERRED EMBODIMENTS

Figure 1:
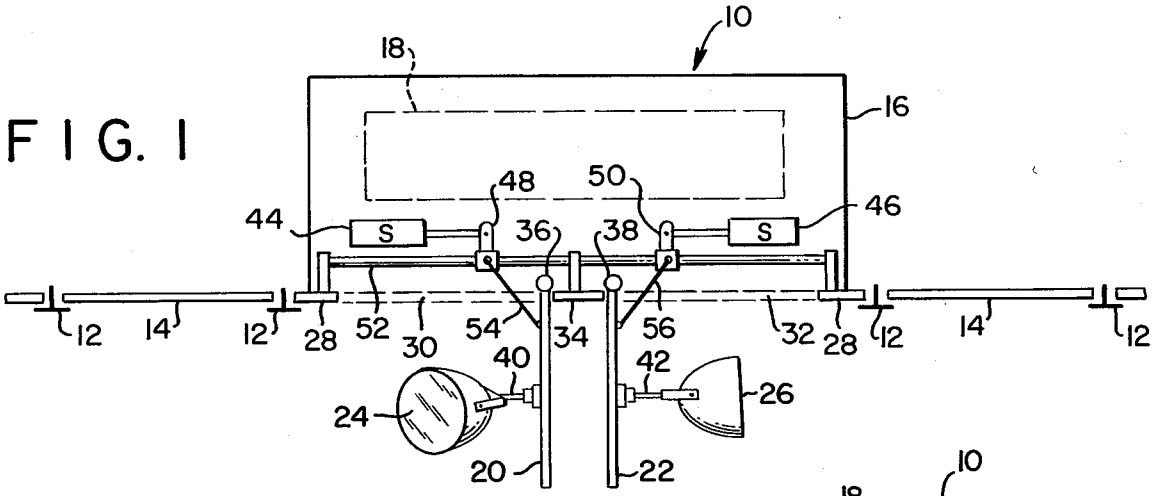
FIG. 1 is a schematic elevational view of an emergency lighting fixture embodying the invention.

Referring now to the drawing in detail, wherein like numerals indicate like elements throughout the several views, an emergency lighting fixture embodying the invention is shown at 10 mounted above a ceiling structure which, in this case, is a suspended ceiling composed of the conventional "T" bars or rails 12 supporting a plurality of rectangular ceiling tiles 14. The details of construction of the suspended ceiling are not critical to the invention, suffice it to say that the suspended ceiling is of the usual construction employing so called "acoustic" type tiles, although this feature is also not essential to the invention.

Figure 2:
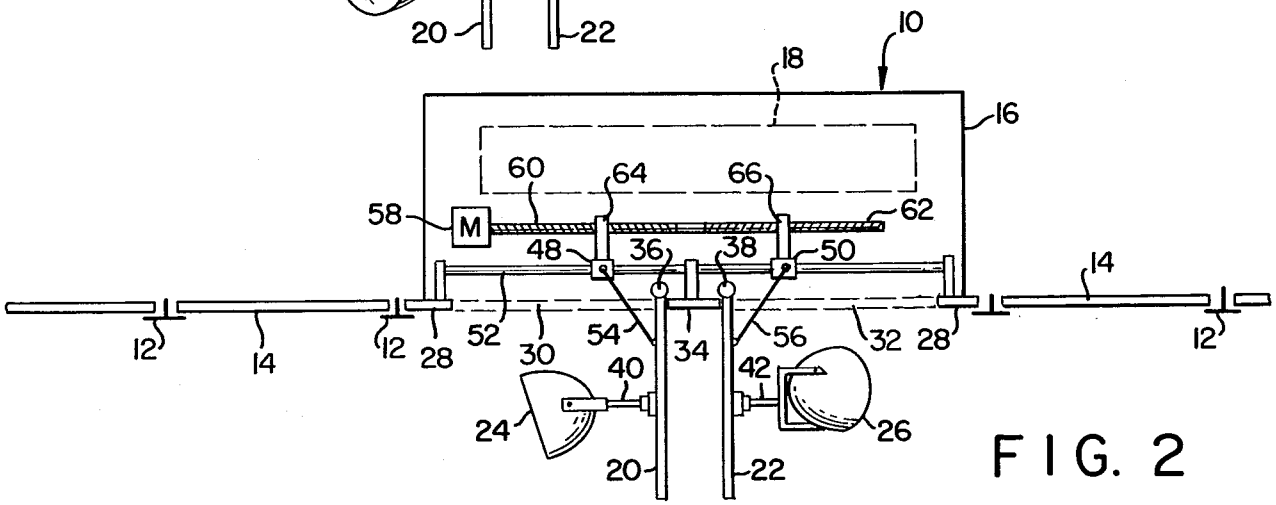
FIG. 2 is a similar view showing another embodiment of the emergency lighting fixture.
Figure 3:
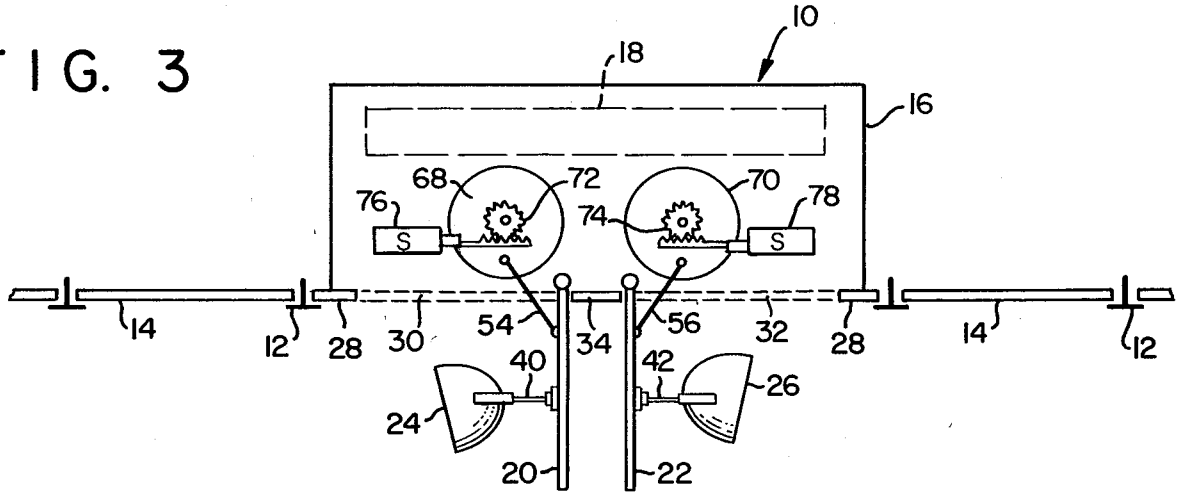
FIG. 3 is a similar view showing still another embodiment of the emergency lighting fixture.

In the several embodiments illustrated in FIGS. 1–3, the emergency lighting fixture 10 includes a casing 16 which encloses all of the electrical and working mechanical components of the light. For purposes of simplicity and ease of description, the electrical components including a d.c. supply, e.g., a rechargeable battery, a charger and switch means, all of which are to be described hereinafter in greater detail, are represented by a dotted outline area 18, while the working mechanical components including a pair of drop down panels 20, 22 and two electric head lamps 24, 26, are shown in the respective positions they would assume when the lighting fixture is placed on emergency service.

The casing 16 is secured onto a bottom plate 28 which fits inside one or more of the rectangular openings defined by the "T" bars or rails 12 supporting the ceiling tiles 14, the latter being removed to allow for mounting of the emergency lighting fixture within the suspended ceiling. The bottom plate 28 is formed with two rectangular shaped openings 30, 32, one provided on each side of a central support bar 34 which separates the two openings. The pair of drop down panels 20, 22 are each movably secured to the support bar 34 by means of hinges as shown at 36, 38, respectively. The panels 20, 22 are made to the same rectangular shape and size as the two openings 30, 32 and are thus adapted to fit inside and close the respective openings, lying flush with the outer surface of the bottom plate 28 when the pair of panels 20, 22 are fully retracted in a manner to be hereinafter described.

The two head lamps 24, 26 are each secured to the inner side of the respective panels 20, 22, facing upwardly into the ceiling structure with the two panels retracted. The lamps 24, 26 may be secured to the panels using standard swivel type mounts 40, 42 which enable the lamps to be positioned in any direction over an angle of 180 degrees with respect to each panel in order to illuminate a given path of egress.

FIG. 1 illustrates an embodiment of an emergency lighting fixture according to the invention wherein the pair of drop down panels 20, 22 and the head lamps 24, 26 are retracted by means of two solenoids 44, 46. Each of the solenoids 44, 46 is connected to one of a pair of sliding bushes 48, 50 which are mounted onto a low friction shaft 52. The shaft 52 is secured to the bottom plate 28 and expands across the length of the casing 16. A pair of panel actuator arms 54, 56 are provided for connecting each of the sliding bushes 48, 50 to one of the panels 20, 22.

During the period when the emergency light is on stand-by service, the two solenoids 44, 46 are continuously energized by the a.c. supply that feeds the normal lighting. If the a.c. supply fails, the solenoids 44, 46 become de-energized and the weight of the two head lamp assemblies causes the panels 20, 22 to drop down or fall to a position determined by the panel actuating arms 54, 56. The two lamps 24, 26 are preset on the swivel mounts 40, 42 in order to illuminate selected paths of egress.

As soon as the a.c. supply has been restored, the two solenoids 44, 46 are again energized and pull each of the sliding bushes 48, 50 along the shaft 52 in opposite directions, which in turn pulls the two panels 20, 22 back into the respective openings 30, 32 to lie flush with the suspended ceiling. The two head lamp assemblies also retract back into the casing 16 and the d.c. power supply for energizing the lamps is automatically cut off as shall be later described in detail.

Instead of using a pair of solenoids 44, 46 in the embodiment of the invention illustrated in FIG. 1, a pair of linear motors can also be employed without changing the basic mechanism involved for dropping and retracting the panels and head lamps. The advantage of using a linear motor is that its actuator arm exerts a force which is substantially constant regardless of the distance traveled whereas the force exerted by a solenoid's actuator arm is proportional to that distance. Accordingly, a linear motor will operate over a longer stroke than may otherwise be possible with the use of a solenoid.

FIG. 2 illustrates another embodiment of an emergency lighting fixture according to the invention wherein the pair of solenoids are replaced by an electric motor 58 and two coupled lead screws 60, 62. The two sliding bushes 48, 50 are each provided with a guide 64, 66 which engages one of the lead screws 60, 62, the latter being oppositely threaded so that the two bushes 48, 50 slide across the shaft 52 in opposite directions when the two coupled screws are rotated by the motor 58. Operation of this emergency lighting fixture is basically the same as that described above. If the a.c. supply fails and power to drive the motor 58 is interrupted, then the two coupled lead screws 60, 62 are free to rotate and allow the two panels 20, 22 and the head lamps 24, 26 to drop down below the level of the suspended ceiling. Again, when the a.c. supply is restored, the motor 58 rotates the two lead screws 60, 62 which in turn cause the panels and head lamps to retract back into the lighting fixture. If desired or necessary, a gear reducer with an idle clutch (not shown) may be mounted to the motor 58 in order to drive the two coupled lead screws 60, 62, the idle clutch allowing instant disconnection of the screws when the motor torque is removed.

In FIG. 3, there is illustrated another embodiment of an emergency lighting fixture according to the invention wherein the two sliding bushes 48, 50 and the shaft 52 are eliminated and replaced by a pair of pulley wheels 68, 70 for retracting the two panels 20, 22 along with the head lamps 24, 26. The two panel actuating arms 54, 56 are connected to the outer rims of the pulley wheels 68, 70 which are rotated by rack and pinion gears generally indicated by the numerals 72, 74. The rack and pinion gears are in turn each driven by separate solenoids 76, 78. Again, these solenoids 76, 78 are continuously energized by the a.c. supply that feeds the normal lighting. If the a.c. supply should fail, the weight of the head lamp assemblies causes the two panels 20, 22 to drop down into the emergency lighting position as shown. When the a.c. supply is restored, the two solenoids 76, 78 are again energized and rotate the two pulley wheels 68, 70, causing the panels and head lamp assemblies to retract back inside the lighting fixture. As described before, the solenoids 76, 78 can be replaced by two linear motors for rotating the pulley wheels.

Figure 4:
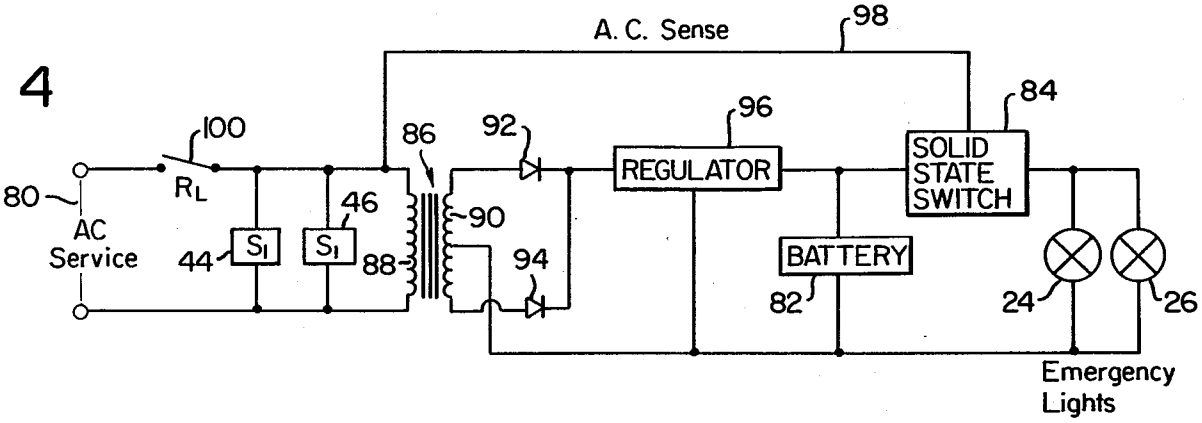
FIG. 4 is a schematic circuit diagram showing the various electrical components used in the emergency lighting fixture of the invention.

FIG. 4 illustrates a circuit for operating an emergency lighting fixture embodying the invention. The circuit includes the electrical components already mentioned, namely, the two head lamps 24, 26, solenoids 44, 46 (76, 78 in FIG. 3) and an a.c. supply 80 which is typically 110 volts A.C. A d.c. supply consisting of a rechargeable battery 82, e.g., a rechargeable nickel-cadmium battery, is provided with its terminals connected across the two head lamps 24, 26. A solid state switch 84 is connected in series between one terminal of the battery 82 and the two head lamps 24, 26. In order to maintain the battery 82 in a fully charged state, a conventional d.c. charger is provided in the circuit including a transformer 86 having primary and secondary windings 88, 90, two rectifying diodes 92, 94 and a voltage regulator 96 connected to a center tap on the secondary transformer winding 90. The two solenoids 44, 46 are connected across the a.c. supply 80 and remain energized so long as a.c. power is present and holds the two drop down panels 20, 22 and head lamps 24, 26 in place within the lighting fixture as described hereinabove. The solid state switch 84 is biased to keep the series connected circuit between the battery 82 and the two lamps 24, 26 open by a signal passed over the line 98 which connects the switch 84 to the a.c. power supply 80. Thus, so long as the switch 84 senses the presence of a.c. power, the two head lamps 24, 26 will remain extinguished. However, if the a.c. supply should fail for any reason, then the solenoids 44, 46 will become de-energized and allow the two panels 20, 22 to drop down from inside the lighting fixture to a level below the suspended ceiling. Simultaneously, the solid state switch 84 senses the absence of a.c. power from the supply and will close the series connected circuit between the battery 82 and the two lamps 24, 26 thus energizing the lamps which are preset to illuminate selected paths of egress.

On restoration of a.c. power, the solid state switch 84 is biased by a signal from the connection 98 to open the circuit between the battery 82 and the two lamps 24, 26 and thus extinguishes the lamps. At the same time, both solenoids 44, 46 are again energized and pull the two panels 20, 22 and lamps 24, 26 back inside of the lighting fixture.

It will of course be understood that the series of actions described hereinabove could be initiated by an emergency other than the loss of a.c. power. For example, the lighting fixture could be placed on emergency service by a signal from a fire alarm or smoke detector going into an alarm mode or some other signal from a building's energy management or security system.

Figure 5:
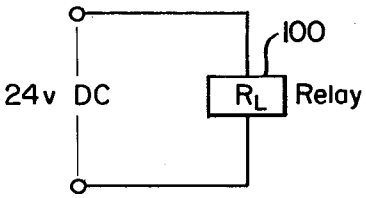

With this in mind, the electrical circuit can be provided with a relay 100 connected between the a.c. supply 80 and the transformer primary winding 88 to interrupt the a.c. power and thus release the drop down panels 20, 22 and energize the lamps 24, 26. The relay 100 may be activated by a 24 volt d.c. signal from a fire alarm pull box, for example, as shown in FIG. 5. Of course, the relay 100 could be activated by an a.c. signal as well as a d.c. signal and the signal could be of any predetermined voltage value. Furthermore, the relay which interrupts the a.c. supply to the transformer, could be located elsewhere, for example, in the transformer secondary circuit.

In the particular case of the embodiment illustrated in FIG. 2, the two solenoids 44, 46 would be replaced by a single a.c. motor 58. The motor 58 is energized by the a.c. supply and closes the two panels 20, 22 in the manner as previously described.

Figure 6:
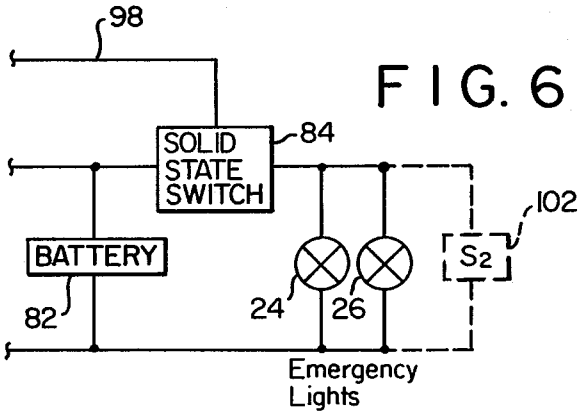
FIGS. 5 and 6 are similar views showing modifications of the circuit of FIG. 4.

In a further modification, an additional solenoid 102 may be connected in parallel across the d.c. supply in order to aid in opening the two panels 20, 22 as shown in FIG. 6.

In addition, the solid state switch employed to interrupt the d.c. supply to the emergency lamps could be replaced by a relay whose coil is energized from either (1) the a.c. service 120 volt or 277 volt, 60 Hz, (2) the transformer secondary voltage or (3) the rectified secondary voltage prior to the regulator. Other modifications of the circuit are of course possible and should readily occur to those skilled in the art.

What is claimed is:

1. An emergency lighting fixture for mounting in a ceiling which comprises, in combination: a panel normally closing an opening in said ceiling, an electric lamp mounted to the inner side of said panel, an a.c. power supply, means responsive to the presence of a.c. power from said power supply for retaining said panel in its normally closing position at said opening, said retaining means being adapted to release said panel and allow said panel to drop under its own weight and the weight of said lamp below said ceiling along with said lamp in the absence of a.c. power, a d.c. power supply and switch means for electrically connecting said d.c. power supply to said lamp in response to the failure of said a.c. power.

2. An emergency lighting fixture according to claim 1, further including a casing enclosing said lamp and said d.c. power supply.

3. An emergency lighting fixture according to claim 2, wherein said panel is hingeably mounted to said casing.

4. An emergency lighting fixture according to claim 2, wherein two panels with a lamp affixed to the inner side of each panel are hingeably mounted to said casing, the panels and lamps being arranged such that when said panels drop below said ceiling, said lamps are positioned to direct their respective beams of light in different directions.

5. An emergency lighting fixture according to claim 4, wherein said panels are hingeably mounted to said casing in a manner whereby said panels are lowered in opposite directions.

6. An emergency lighting fixture according to claim 1, wherein said panel retaining means comprises a bushing slidably mounted onto a low friction shaft, an actuating arm connected between said bushing and said panel and electric drive means for sliding said bushing along said shaft, said drive means electrically connected to said power supply.

7. An emergency lighting fixture according to claim 6, wherein said drive means is an electric solenoid.

8. An emergency lighting fixture according to claim 7, wherein said drive means is a linear motor.

9. An emergency lighting fixture according to claim 1, wherein said panel retaining means comprises a threaded bushing mounted onto a lead screw and electric drive means for rotating said screw, said drive means being electrically connected to said power supply.

10. An emergency lighting fixture according to claim 9, wherein said drive means is an electric motor.

11. An emergency lighting fixture according to claim 1, wherein said panel retaining means comprises a pulley wheel, an actuating arm connected between said pulley wheel and said panel and drive means for rotating said pulley wheel, said drive means electrically connected to said power supply.

12. An emergency lighting fixture according to claim 11, wherein said drive means is an electric solenoid.

13. An emergency lighting fixture according to claim 11, wherein said drive means is a linear motor.

14. An emergency lighting fixture according to claim 1, wherein said switch means comprises a solid state switch connected in series between said d.c. power supply and said lamp.

15. An emergency lighting fixture according to claim 14, further including means for biasing said switch to close said series connection between said d.c. power supply and said lamp upon failure of said a.c. power.

16. An emergency lighting fixture for mounting in a ceiling which comprises, in combination: a panel normally closing an opening in said ceiling, an electric lamp mounted behind said panel, an a.c. power supply, a movable actuator member, an actuating arm connected between said actuator member and said panel, electric drive means connected to said a.c. power supply, said drive means being adapted to move said actuator member in one direction to retain said panel in its normally closing position at said opening and in an opposite direction to release said panel and allow said panel to drop below said ceiling along with said lamp in the absence of a.c. power, a d.c. power supply and switch means for electrically connecting said d.c. power supply to said lamp in response to the failure of said a.c. power.

17. An emergency lighting fixture according to claim 16, further including a casing enclosing said lamp and said d.c. power supply.

18. An emergency lighting fixture according to claim 17, wherein said panel is hingeably mounted to said casing and wherein said lamp is affixed to the inner side of said panel.

19. An emergency lighting fixture according to claim 17, wherein two panels with a lamp affixed to the inner side of each panel are hingeably mounted to said casing in a manner whereby said panels are lowered in opposite directions, and wherein said lamps are arranged such that when said panels drop below said ceiling, said lamps are positioned to direct their respective beams of light in different directions.

20. An emergency lighting fixture according to claim 16, wherein said actuator member is a bushing slidably mounted onto a low friction shaft and wherein said drive means is connected to said bushing for sliding said bushing along said shaft.

21. An emergency lighting fixture according to claim 20, wherein said drive means is an electric solenoid.

22. An emergency lighting fixture according to claim 20, wherein said drive means is a linear motor.

23. An emergency lighting fixture according to claim 16, wherein said actuator member is a threaded bushing mounted onto a lead screw and wherein said drive means is connected to said threaded screw for rotating said screw.

24. An emergency lighting fixture according to claim 23, wherein said drive means is an electric motor.

25. An emergency lighting fixture according to claim 16, wherein said actuator member is a pulley wheel and wherein said drive means is connected to said pulley wheel for rotating said wheel.

26. An emergency lighting fixture according to claim 25, wherein said drive means is an electric solenoid.

27. An emergency lighting fixture according to claim 25, wherein said drive means is a linear motor.

28. In a suspended ceiling including a plurality of ceiling tiles supported by rails wherein at least one of said ceiling tiles is replaced by an emergency lighting fixture, said fixture comprising, in combination:

a casing having at least one opening therein;

a panel hingeably mounted to said casing and normally closing said opening;

an electric lamp affixed to the inner side of said panel;

an a.c. power supply;

means responsive to the presence of a.c. power from said power supply for retaining said panel in its normally closing position at said opening, said retaining means being adapted to release said panel and allow said panel to drop under its own weight and the weight of said lamp below said ceiling along with said lamp in the absence of a.c. power;

a d.c. power supply; and switch means for electrically connecting said d.c. power supply to said lamp in response to the failure of said a.c. power.

29. In a suspended ceiling including a plurality of ceiling tiles supported by rails wherein at least one of said ceiling tiles is replaced by an emergency lighting fixture, said fixture comprising, in combination:

a casing having at least one opening therein;

a panel hingeably mounted to said casing and normally closing said opening;

an electric lamp;

means for adjustably affixing said lamp to the inner side of said panel;

an a.c. power supply;

means responsive to the presence of a.c. power from said power supply for retaining said panel in its normally closing position at said opening, said retaining means being adapted to release said panel and allow said panel to drop under its own weight and the weight of said lamp below said ceiling along with said lamp in the absence of a.c. power;

a d.c. power supply;

circuit means for charging said d.c. power supply; and switch means for electrically connecting said d.c. power supply to said lamp in response to the failure of said a.c. power.

30. The suspended ceiling according to claim 29, wherein said means for adjustably affixing said lamp comprises a swivel mount.

31. The suspended ceiling according to claim 29, further including electric drive means connected to said d.c. power supply to assist the release of said panel upon failure of said a.c. power.

32. The suspended ceiling according to claim 31, wherein said drive means is an electric solenoid.

* * * * *